US008567424B2

(12) United States Patent
Hill, Sr.

(10) Patent No.: US 8,567,424 B2
(45) Date of Patent: Oct. 29, 2013

(54) TENT AND TENT FRAME

(76) Inventor: Gregory P. Hill, Sr., Fair Oaks, CA (US)

( * ) Notice: Subject to any disclaimer, the term of this patent is extended or adjusted under 35 U.S.C. 154(b) by 66 days.

(21) Appl. No.: 13/189,407

(22) Filed: Jul. 22, 2011

(65) Prior Publication Data

US 2012/0017957 A1 Jan. 26, 2012

Related U.S. Application Data

(60) Provisional application No. 61/367,333, filed on Jul. 23, 2010.

(51) Int. Cl.
*E04H 15/40* (2006.01)

(52) U.S. Cl.
USPC ..... 135/125; 135/906

(58) Field of Classification Search
USPC ..... 135/114, 120.3, 124, 125, 126, 87, 906; 403/293, 298; 5/127, 128, 129
See application file for complete search history.

(56) References Cited

U.S. PATENT DOCUMENTS

| | | | | | |
|---|---|---|---|---|---|
| 935,445 | A | * | 9/1909 | McClellen | 5/129 |
| 2,167,219 | A | | 7/1939 | Sankey | |
| 2,353,561 | A | * | 7/1944 | Hassett | 285/322 |
| 2,651,058 | A | * | 9/1953 | Almoslino | 5/110 |
| 2,961,802 | A | * | 11/1960 | Mongan et al. | 52/81.4 |
| 3,388,711 | A | * | 6/1968 | Huddle | 135/123 |
| 3,675,667 | A | | 7/1972 | Miller | |
| 3,856,029 | A | * | 12/1974 | Huddle | 135/132 |
| 3,941,140 | A | | 3/1976 | Beavers | |
| 3,960,161 | A | | 6/1976 | Norman | |
| 3,990,463 | A | | 11/1976 | Norman | |
| 4,026,312 | A | | 5/1977 | Beavers | |
| 4,102,352 | A | | 7/1978 | Kirkham | |
| 4,719,934 | A | * | 1/1988 | Mydans | 135/90 |
| 4,739,784 | A | * | 4/1988 | Fast | 135/117 |
| 4,825,892 | A | | 5/1989 | Norman | |
| 4,858,634 | A | | 8/1989 | McLeese | |
| 5,014,728 | A | | 5/1991 | Arnold | |
| 5,137,044 | A | | 8/1992 | Brady | |
| 5,144,780 | A | * | 9/1992 | Gieling et al. | 52/298 |
| 5,163,461 | A | | 11/1992 | Ivanovich et al. | |
| 5,215,109 | A | * | 6/1993 | Kent, Jr. | 135/137 |
| D341,407 | S | | 11/1993 | McLeese | |

(Continued)

FOREIGN PATENT DOCUMENTS

| | | |
|---|---|---|
| GB | 459986 | 1/1937 |

*Primary Examiner* — Noah Chandler Hawk
(74) *Attorney, Agent, or Firm* — James W. Hill; M. Todd Hales; McDermott Will & Emery LLP

(57) ABSTRACT

A tent frame includes a plurality of structural members (PSM), each having a first end portion and a second end portion. The tent frame also includes a connecting member having a first part and a second part. The first end portion of each of the PSM couples to the first part, and the second end portion of each of the PSM couples to the second part, such that at least one of a tensional force, a bending force, a compressive force, and a torsional force is exerted on each of the PSM. One of the PSM and the connecting member form a first side of a tent frame. Another of the PSM and the connecting member form a second side of the tent frame. When the at least one of the tensional force, the bending force, the compressive force, and the torsional force is decreased, the tent frame expands longitudinally.

21 Claims, 14 Drawing Sheets

(56) References Cited

U.S. PATENT DOCUMENTS

| | | | | |
|---|---|---|---|---|
| 5,337,772 | A | 8/1994 | Habchi | |
| 5,390,463 | A * | 2/1995 | Sollner | 52/650.2 |
| 5,396,917 | A | 3/1995 | Hazinski et al. | |
| 5,601,105 | A | 2/1997 | Blen et al. | |
| 5,636,392 | A * | 6/1997 | Choi | 5/127 |
| 5,638,850 | A | 6/1997 | Hazinski et al. | |
| RE35,571 | E | 7/1997 | McLeese | |
| 5,645,096 | A | 7/1997 | Hazinski et al. | |
| 5,676,168 | A | 10/1997 | Price | |
| 5,794,637 | A | 8/1998 | Figueroa | |
| 5,809,592 | A * | 9/1998 | McAllister | 5/99.1 |
| D400,949 | S | 11/1998 | Gale | |
| 5,941,261 | A | 8/1999 | Kouvaras et al. | |
| 6,006,769 | A | 12/1999 | Lin | |
| 6,109,282 | A | 8/2000 | Yoon | |
| 6,145,527 | A | 11/2000 | Gillis | |
| 6,170,504 | B1 | 1/2001 | Tsai | |
| 6,186,157 | B1 | 2/2001 | Lin et al. | |
| D441,040 | S | 4/2001 | Cho | |
| 6,286,531 | B1 * | 9/2001 | Joo-Tai | 135/114 |
| 6,328,049 | B1 | 12/2001 | Kim | |
| 6,415,806 | B1 | 7/2002 | Gillis | |
| 6,517,444 | B1 * | 2/2003 | Yoon | 473/197 |
| 6,595,227 | B2 * | 7/2003 | Le Gette et al. | 135/126 |
| 6,672,323 | B2 | 1/2004 | Gupta et al. | |
| 6,866,055 | B2 * | 3/2005 | Scherer | 135/125 |
| D534,615 | S | 1/2007 | van Aalst | |
| 7,174,584 | B2 | 2/2007 | Danaher | |
| 7,302,957 | B2 * | 12/2007 | Ross | 135/126 |
| 7,316,239 | B2 * | 1/2008 | Yang | 135/137 |
| 7,578,306 | B2 | 8/2009 | Mettavant | |
| 7,607,445 | B2 | 10/2009 | von Dewitz et al. | |
| 7,725,965 | B2 * | 6/2010 | Sanford-Schwentke | 5/128 |
| 2003/0066550 | A1 * | 4/2003 | Al-Ghamdi | 135/121 |
| 2006/0037553 | A1 | 2/2006 | Miller et al. | |
| 2010/0101618 | A1 | 4/2010 | van Aalst | |

* cited by examiner

TENT AND TENT FRAME

RELATED APPLICATIONS

The present application claims the benefit of U.S. Provisional Patent Application Ser. No. 61/367,333, entitled "Tent and Tent Frame," filed on Jul. 23, 2010, which is hereby incorporated by reference in its entirety for all purposes.

FIELD

The present invention generally relates to portable structures and, in particular, relates to tents and tent frames.

BACKGROUND

Tents are typically used for recreational camping and temporary shelters. Tents may be practical and economical because of their portability. Tents may be constructed in various sizes. For example, some tents may be sufficiently light that they can be carried for long distances on a bicycle, a boat, or even a person's back. Tents are typically assembled such that they stand upright for use.

SUMMARY

According to various embodiments of the subject disclosure, a tent frame is provided. The tent frame comprises a plurality of structural members, each having a first end portion and a second end portion. The tent frame also comprises a first connecting member having a first part and a second part. In some embodiments, each of the plurality of structural members comprises at least one of a pole, a rod, a pipe, a lug, a clip, and a cam. In some embodiments, the first connecting member comprises at least one of a cord, a string, a rope, a cable, and a guy line.

The first end portion of each of the plurality of structural members couples to the first part of the first connecting member, and the second end portion of each of the plurality of structural members couples to the second part of the first connecting member, such that at least one of a tensional force, a bending force, a compressive force, and a torsional force is exerted on each of the plurality of structural members.

One of the plurality of structural members and the first connecting member form a first side of a tent frame. Another of the plurality of structural members and the first connecting member form a second side of the tent frame. When the at least one of the tensional force, the bending force, the compressive force, and the torsional force is decreased, the tent frame expands longitudinally.

In some embodiments, when the tent is in an upright position, the first connecting member extends longitudinally along a top portion of the tent and the plurality of structural members are bent in a concave upward facing direction. In some embodiments, the plurality of structural members comprises two structural members.

According to certain embodiments, the tent frame further comprises a spool that couples to the first connecting member, and a second connecting member that couples to the spool and having a first part and a second part. The first part of the second connecting member couples to one of the two structural members. The second part of the second connecting member couples to another of the two structural members. In some embodiments, the second connecting member comprises at least one of a cord, a string, a rope, a cable, and a guy line.

In certain embodiments, the first part of the second connecting member couples to a mid-region of the one of the two structural members, and the second part of the second connecting member couples to a mid-region of the another of the two structural members. In some embodiments, when a transverse force is exerted on at least one of the two structural members urging the two structural members toward one another, the second connecting member exerts a counter-transverse force on at least one of the two structural members to resist the transverse force.

In some embodiments, the tent frame further comprises at least one secondary structural member. The at least one secondary structural member may be bent in a concave downward facing direction and extend longitudinally along the tent frame. In some embodiments, the second connecting member is configured to engage a mid-region of the at least one secondary structural member. In some embodiments, the second connecting member is configured to restrict movement of the at least one secondary structural member in at least one of an upward and outward direction relative to the tent frame. In some embodiments, the at least one secondary structural member is coupled to one of the two structural members at two different locations of the at least one secondary structural member.

In some embodiments, the spool comprises a first plate having a first node defining a first hole through which the first connecting member extends. The first plate comprises a first tip portion on which a first groove is defined. The first groove is configured to engage the second connecting member. The spool also comprises a second plate having a second node defining a second hole through which the first connecting member extends. The second plate comprises a second tip portion on which a second groove is defined. The second groove is configured to engage the second connecting member. The first node and the second node couple to one another to form a pivot point such that the first plate and the second plate are rotatable relative to one another about the pivot point. When the first plate is aligned with the second plate, the first groove and the second groove form a third hole through which the second connecting member extends.

In some embodiments, the tent frame comprises a fastening member configured to couple the first end portion of a first one of the plurality of structural members to at least one of the first part and the first end portion of a second one of the plurality of structural members. In some embodiments, the fastening member comprises one or more protrusions configured to engage the first connecting member. In some embodiments, the fastening member comprises one of a hole and a tip portion. The first end portion of the first one of the plurality of structural members comprises the other of the hole and the tip portion. The tip portion is configured to insert into the hole for coupling the fastening member to the first end portion of the first one of the plurality of structural members.

In some embodiments, at least one of the plurality of structural members comprises a plurality of segments that couple one another to form the at least one of the plurality of structural members. In some embodiments, the tent frame further comprises a coupling member having a plurality of grooves and a plurality of teeth portions formed within a hole defined through the coupling member. Each of the plurality of segments comprises at least one fitting portion having a plurality of grooves and a plurality of teeth portions. The at least one fitting portion is configured to engage the plurality of grooves and the plurality of teeth portions formed within the hole of the coupling member.

In some embodiments, the frame is configured to couple to a fabric for forming a tent. In some aspects, the tent is provided with the tent supporting structures. In some aspects, the tent comprises the fabric, and in other embodiments, the fabric can be coupled to, or be separate from, the tent or the tent supporting structure.

According to various embodiments of the subject technology, a tent frame is provided. The tent frame comprises a plurality of structural members, each having a first end portion and a second end portion. The tent frame also comprises a first connecting member having a first part and a second part. The first end portion of each of the plurality of structural members couples to the first part of the first connecting member, and the second end portion of each of the plurality of structural members couples to the second part of the first connecting member, such that a tensional force is exerted on each of the plurality of structural members. One of the plurality of structural members and the first connecting member form a first side of a tent frame. Another of the plurality of structural members and the first connecting member form a second side of the tent frame. When the tensional force is decreased, the tent frame expands longitudinally.

According to various embodiments of the subject technology, a tent frame is provided. The tent frame comprises a plurality of structural members, each having a first end portion and a second end portion. The tent frame also comprises a first connecting member having a first part and a second part. The first end portion of each of the plurality of structural members couples to the first part of the first connecting member, and the second end portion of each of the plurality of structural members couples to the second part of the first connecting member, such that a bending force is exerted on each of the plurality of structural members. One of the plurality of structural members and the first connecting member form a first side of a tent frame. Another of the plurality of structural members and the first connecting member form a second side of the tent frame. When the bending force is decreased, the tent frame expands longitudinally.

According to various embodiments of the subject technology, a tent frame is provided. The tent frame comprises a plurality of structural members, each having a first end portion and a second end portion. The tent frame also comprises a first connecting member having a first part and a second part. The first end portion of each of the plurality of structural members couples to the first part of the first connecting member, and the second end portion of each of the plurality of structural members couples to the second part of the first connecting member, such that a compressive force is exerted on each of the plurality of structural members. One of the plurality of structural members and the first connecting member form a first side of a tent frame. Another of the plurality of structural members and the first connecting member form a second side of the tent frame. When the compressive force is decreased, the tent frame expands longitudinally.

According to various embodiments of the subject technology, a tent frame is provided. The tent frame comprises a plurality of structural members, each having a first end portion and a second end portion. The tent frame also comprises a first connecting member having a first part and a second part. The first end portion of each of the plurality of structural members couples to the first part of the first connecting member, and the second end portion of each of the plurality of structural members couples to the second part of the first connecting member, such that a torsional force is exerted on each of the plurality of structural members. One of the plurality of structural members and the first connecting member form a first side of a tent frame. Another of the plurality of structural members and the first connecting member form a second side of the tent frame. When the torsional force is decreased, the tent frame expands longitudinally.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the subject technology as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology.

Tents may use poles and guy lines for structurally supporting the tents. The guy lines may connect to external anchors such as stakes, trees, rocks, etc., for structurally supporting the tents. It can be advantageous to provide a tent that may be structurally supported without relying on outside anchors. For example, in some instances there is not enough room where a tent is placed to extend out the guy lines for the external anchors. Failing to provide the external anchors, when such external anchors assist in providing support to the tent structure, can result in a tent structure not operating as intended, and can result in, for example, tent structure failure or collapse. In some embodiments, a tent and/or tent frame is provided that is internally balanced and does not rely on outside anchors. In some embodiments, an internally balanced suspension tent is provided.

Figure 1:
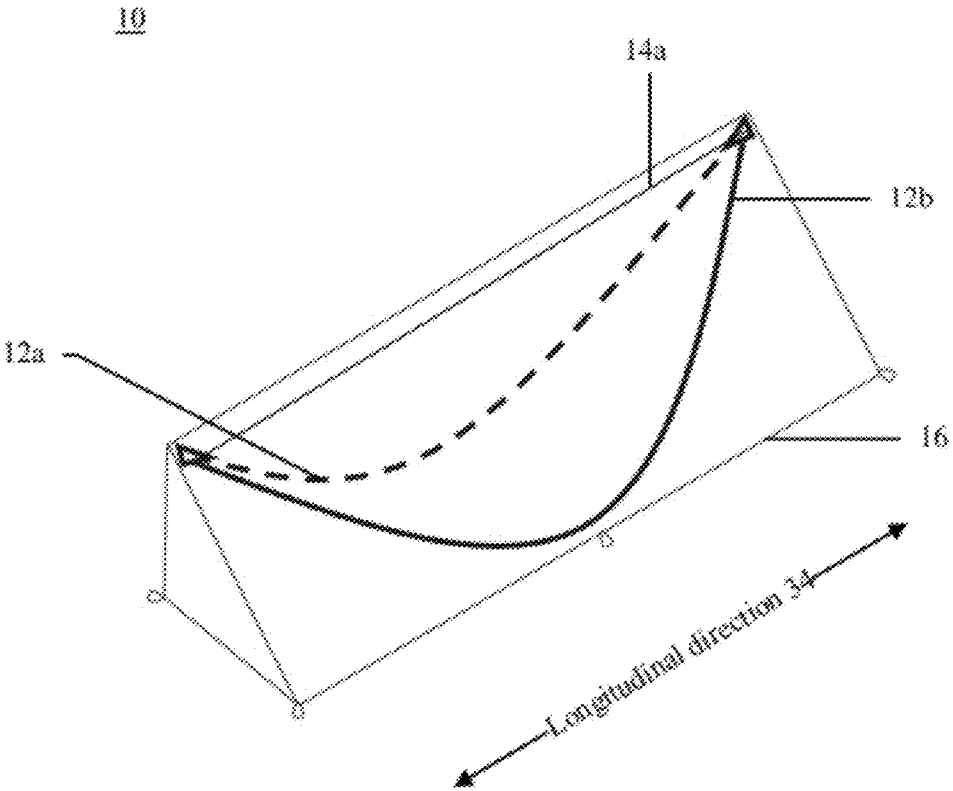
FIG. 1 illustrates a perspective view of a tent, in accordance with various embodiments of the subject technology.

FIG. 1 illustrates a perspective view of tent 10, in accordance with various embodiments of the subject technology. In some embodiments, tent 10 comprises a plurality of structural members, each having a first end portion and a second end portion. FIG. 1 illustrates tent 10 having two structural members, structural member 12*a* and structural member 12*b*. However, the subject technology is not limited to two structural members. In some embodiments, tent 10 may comprise more or less structural members. Although each structural member is shown as a single segment, each structural member may comprise a plurality of segments to form a structural member (e.g., a plurality of segments coupled together in parallel and/or series to form a structural member). In some embodiments, a structural member may comprise at least one of a pole, a rod, a pipe, a lug, a clip, a cam, and another suitable mechanism used for structurally supporting tent 10. In some embodiments, a structural member may be stiff and/or compliant.

In some embodiments, tent 10 comprises connecting member 14*a*. Although connecting member 14*a* is shown as a single segment, connecting member 14*a* may comprise a plurality of segments to form the connecting member (e.g., a plurality of segments coupled together in parallel and/or series to form the connecting member). In some embodiments, a connecting member may comprise at least one of a cord, a string, a rope, a cable, a guy line, and another suitable mechanism used for connecting the structural members. For example, in some embodiments, a connecting member may be a tension member that utilizes tension in connecting various objects together. The tension does not necessarily have to be detectable by the naked eye, but may also undetectable to the naked eye (e.g., in solid objects like a steel rod). In some embodiments, a connecting member may be stiff and/or compliant. In some embodiments, tent 10 may comprise more or less connecting members. In some aspects, cord, string, rope, cable, and guy line, as used herein, may refer to elongate and flexible members.

In some embodiments, the first end portion of each of the plurality of structural members couples to the first part of a connecting member, and the second end portion of each of the plurality of structural members couples to the second part of the connecting member, such that at least one of a tensional force, a bending force, a compressive force, and a torsional force is exerted on each of the plurality of structural members. In some embodiments, when the at least one of the tensional force, the bending force, the compressive force, and the torsional force is decreased, a frame of tent 10 expands longitudinally. For example, according to certain embodiments, if the connecting member were released from the plurality of the structural members or removed, tent 10 may collapse (e.g., longitudinally) and each of the plurality of structural members may return to a substantially straight configuration, allowing for simple and convenient stowage of the plurality of the structural members. In some aspects, bending, as used herein, is given its ordinary meaning. In some aspects, bending, as used herein, may refer to flexing (e.g., flexing a structural member in a curved fashion or angularly at a joint).

Figure 2:
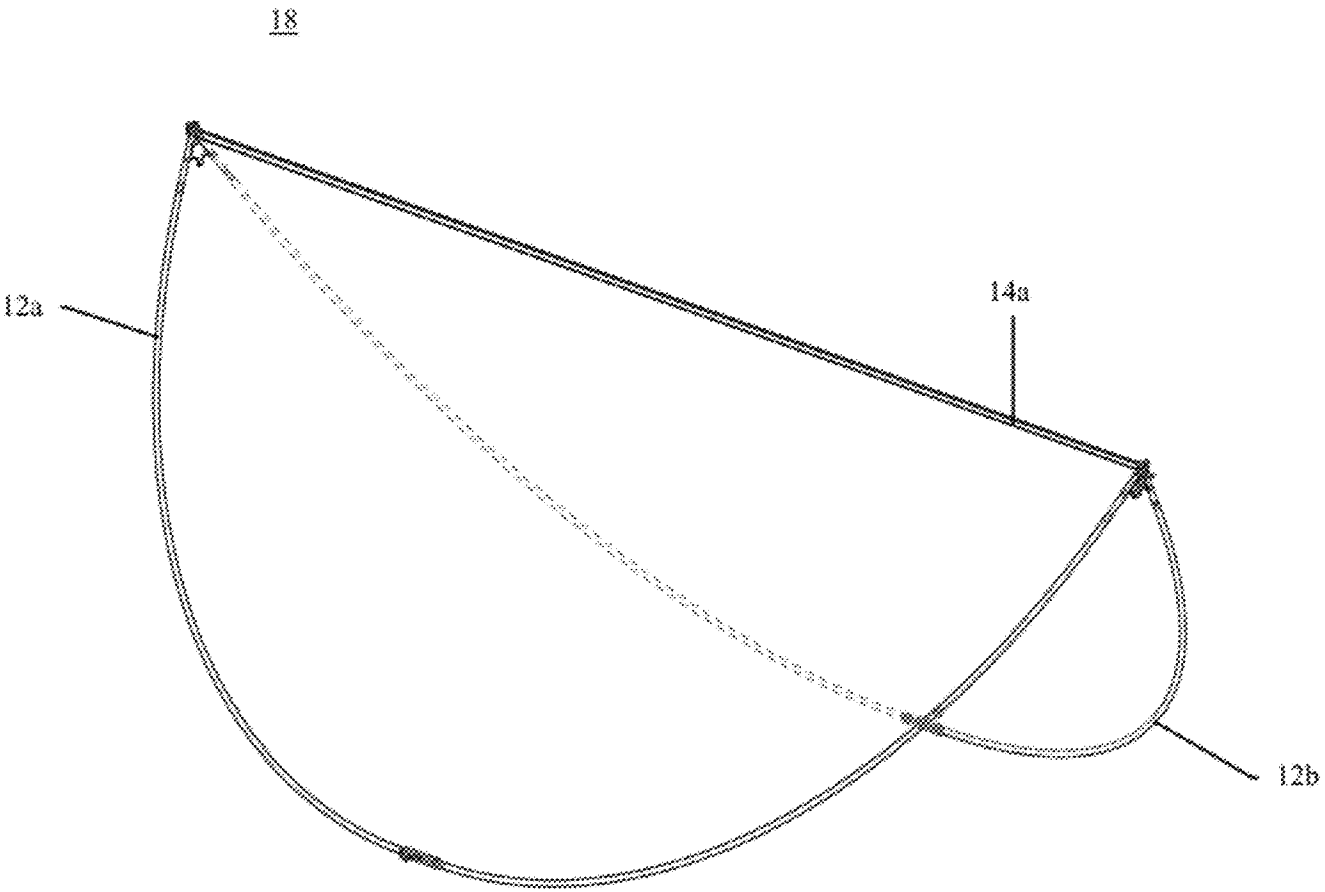
FIG. 2 illustrates a perspective view of a frame, in accordance with various embodiments of the subject technology.

As shown in FIG. 1, structural members 12*a* and 12*b* are coupled to connecting member 14*a* such that at least one of a tensional force, a bending force, a compressive force, and a torsional force is exerted on structural members 12*a* and 12*b*, causing structural members 12*a* and 12*b* to bend in a concave upward facing direction. Connecting member 14*a* extends longitudinally along a top portion of tent 10, as shown by longitudinal direction 34. In some embodiments, connecting member 14*a* and structural members 12*a* and 12*b* form a frame for tent 10. FIG. 2 illustrates frame 18 as an example of the frame formed by connecting member 14*a* and structural members 12*a* and 12*b*, in accordance with various embodiments of the subject technology. Structural member 12*b* is illustrated in part with dotted lines to show that structural member 12*b* is behind structural member 12*a* in the view provided in FIG. 2.

Structural member 12*a* and connecting member 14*a* form a first side of frame 18, while structural member 12*b* and connecting member 14*a* form a second side of frame 18. Frame 18 is configured to couple to fabric 16 (e.g., shown in FIG. 1) for forming tent 10. In some aspects, tent 10 comprises fabric 16. Tent 10 is shown with its apex as a sharp edge instead of a dome. In this regard, snow cannot accumulate on the apex, making tent 10 more resistant to snow loads being formed on tent 10.

Although connecting member 14*a* is shown as extending along a top portion of tent 10 and structural members 12*a* and 12*b* to bend in a concave upward facing direction, other suitable configurations may be used. However, by having the structural members 12*a* and 12*b* in a concave upward facing direction, the body of tent 10 may have what is referred to in aerodynamics as "negative camber." In this regard, the body of tent 10, when acted upon by air flow, may have less tendency to be lifted than other typical tents without such a configuration. Thus, in some embodiments, tent 10 may be less likely to be blown away during windy conditions.

In some embodiments, frame 18 internally balances structural loads between its structural members and its connecting members. The balance of these structural loads may provide tent 10 with strength and rigidity. In some embodiments, outside anchors are not relied upon for structurally supporting tent 10. In some embodiments, by using the connecting members to couple to the structural members to form the frame of tent 10, and to form a portion of the tent structure itself, less structural members may be needed, thereby resulting in a lighter frame and a lighter tent 10 compared to other typical tents. Stated another way, the frame provided by tent 10 is stronger for the same weight as other typical tents because, for example, the connecting member operates as a portion of the tent structure.

Figure 3:
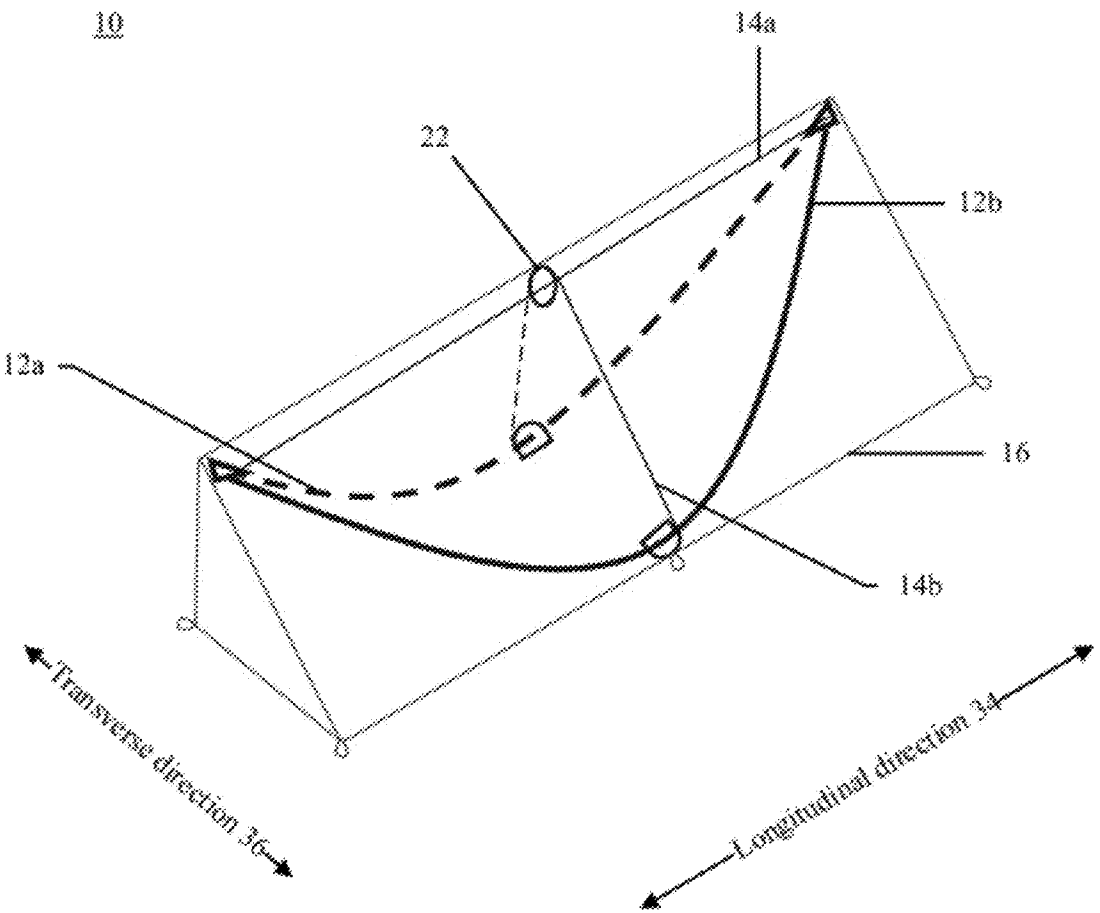
FIG. 3 illustrates a perspective view of a tent using two connecting members, in accordance with various embodiments of the subject technology.

FIG. 3 illustrates a perspective view of tent 10 using a second connecting member 14*b*, in accordance with various embodiments of the subject technology. In some embodiments, tent 10 comprises spool 22 that couples connecting member 14*a*. In some embodiments, connecting member 14*b* couples to spool 22 and comprises a first part and a second part. The first part of connecting member 14*b* couples to one of the two structural members 12*a* and 12*b* and the second part of connecting member 14*b* couples to the other of the two structural members 12*a* and 12*b*. In some aspects, spool, as used herein includes a structure that has flexible material (e.g., a connecting member) at least partially wound around the structure, but does not necessarily require the flexible material to be fully wound around the structure. Spool 22 is not limited to a cylindrical structure. For example, spool 22 may have at least one of an elliptical and a polygonal cross section. In some aspects, spool 22 may have a cross section similar to a piece of a pie.

Figure 4:
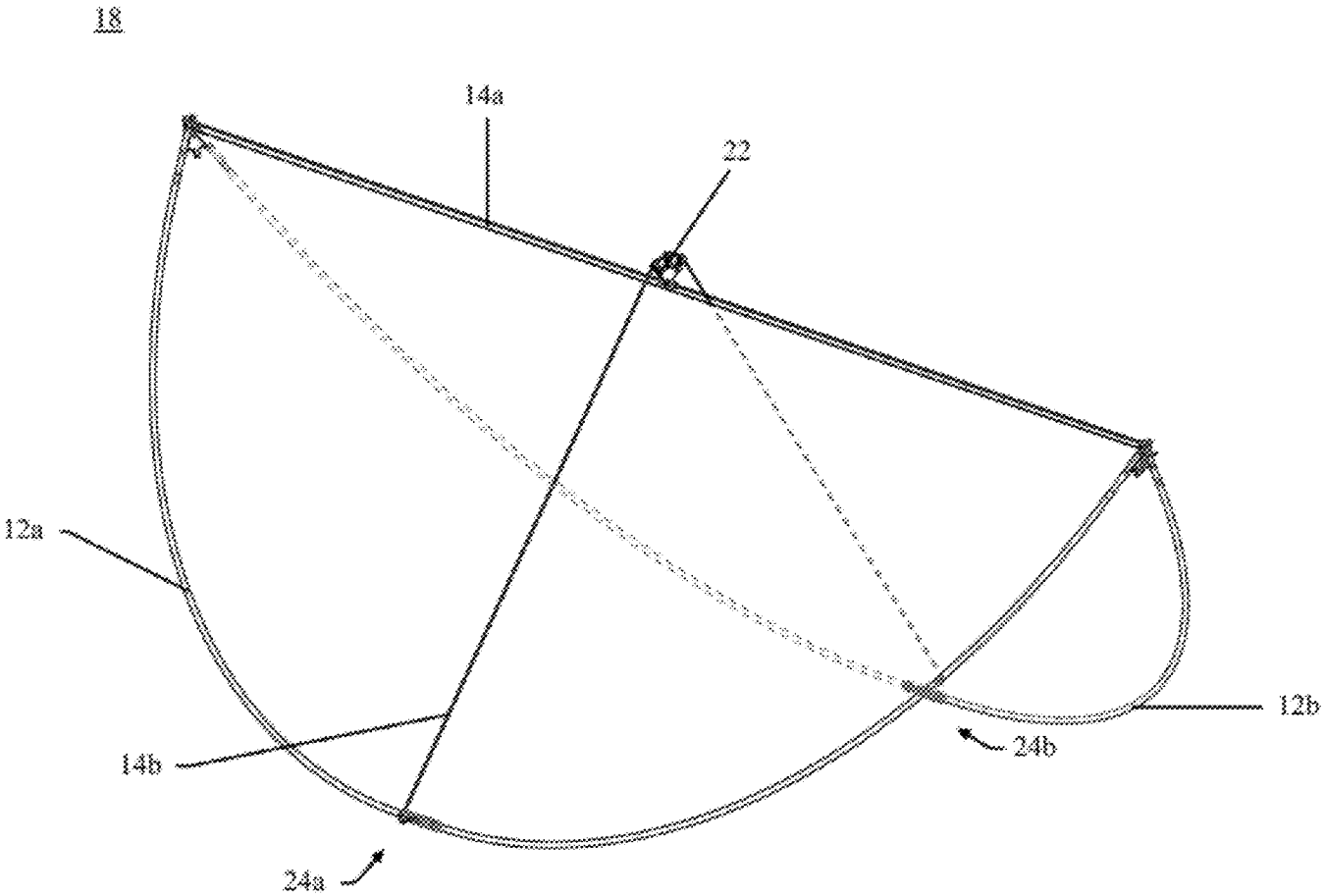
FIG. 4 illustrates a perspective view of a frame using two connecting members, in accordance with various aspects of the subject technology.

For example, as shown in FIG. 4, a first part of connecting member 14*b* couples to mid-region 24*a* of structural member 12*a* while a second part of connecting member 14*b* couples to mid-region 24*b* of structural member 12*b*. However, connecting member 14*b* is not limited to being coupled to the mid-regions of a structural member but may be coupled to other regions of a structural member. Structural member 12*b* and connecting member 14*b* are illustrated in part with dotted lines to show that structural member 12*b* and the dotted portion of connecting member 14*b* are behind structural member 12*a* in the view provided in FIG. 4.

Referring back to FIG. 3, connecting member 14*b* extends in transverse direction 36. In some embodiments, by coupling connecting member 14*b* to structural members 12*a* and 12*b*, additional structural support is provided for tent 10. This additional structural support may be illustrated with reference to FIG. 5.

Figure 5:
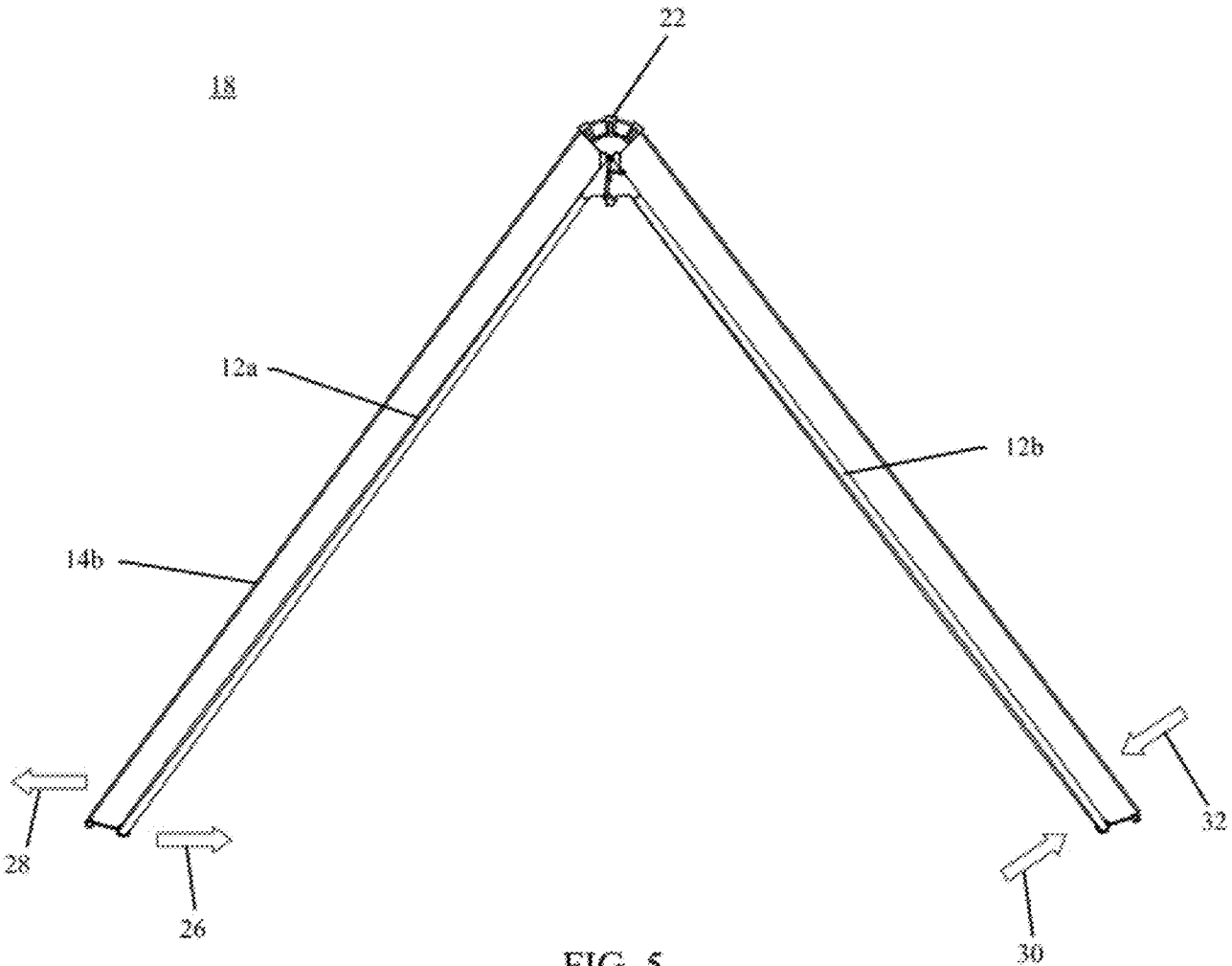
FIG. 5 illustrates a side view of a frame, in accordance with various embodiments of the subject technology.

FIG. 5 illustrates a side view of frame 18, in accordance with various embodiments of the subject technology. A transverse force (e.g., an external load like wind, snow, etc.) may be exerted on tent 10 such that structural members 12*a* and 12*b* are urged toward one another. This transverse force is illustrated, for example, by arrow 32. Connecting member 14*b* may exert a counter-transverse force on at least one of the two structural members 12*a* and 12*b* to resist the transverse force, as illustrated for example by arrow 30. In some embodiments, connecting member 14*b* resists movement of structural members 12*a* and 12*b* toward one another. This is, for example, similar to an anatomical mechanism in which a taut topside muscle may keep two bones from moving closer together within a joint.

In some embodiments, the transverse force may be exerted on tent 10 such that structural members 12*a* and 12*b* move away from each other, as illustrated for example by arrow 28. In such a case, a floor of tent 10 may act to resist that movement. For example, fabric 16 may be coupled to frame 18 such that fabric 16 forms the floor of tent 10. Fabric 16 may resist structural members 12*a* and 12*b* from moving away from one another.

Figure 6A:
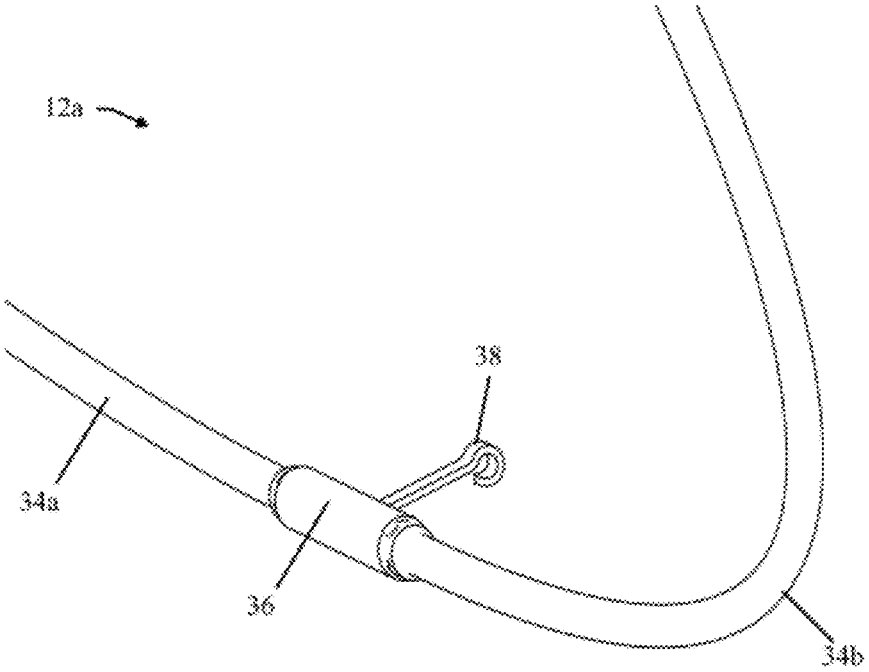
FIGS. 6A and 6B illustrate perspective views of a coupling member used to couple two segments together, in accordance with various embodiments of the subject technology.
Figure 6B:
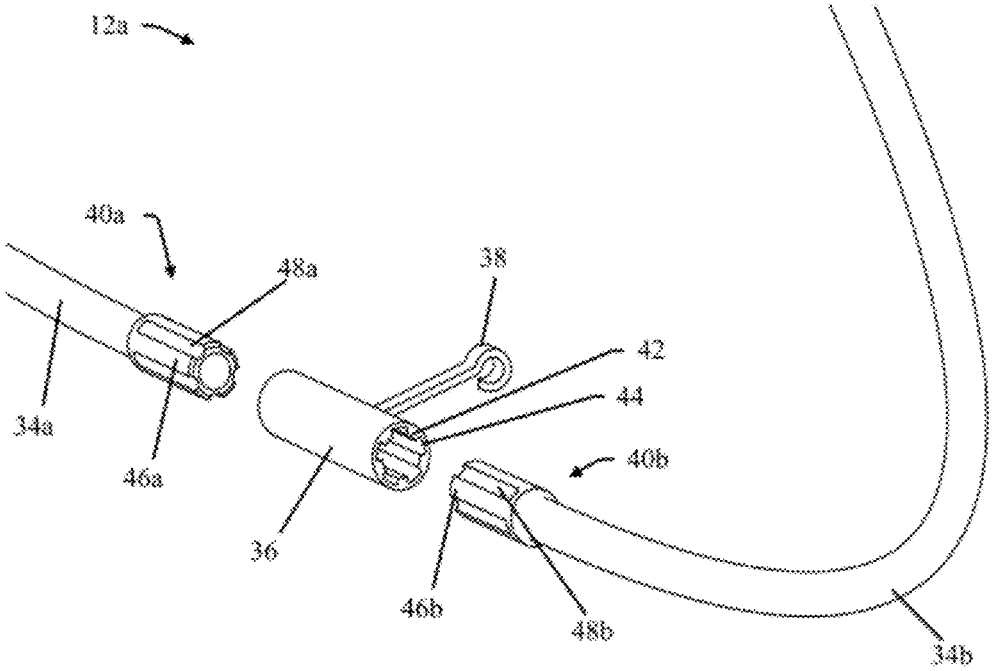

According to various embodiments of the subject technology, a structural member of tent 10 may comprise a plurality of segments that couple to one another to form the structural member. FIGS. 6A and 6B illustrate an example of coupling member 36 used to couple segments 34*a* and 34*b* together to form structural member 12*a*, in accordance with various embodiments of the subject technology. In some embodiments, coupling member 36 comprises a plurality of grooves 44 and a plurality of teeth portions 42 formed within a hole defined through coupling member 36.

Segment 34*a* comprises fitting portion 40*a* having a plurality of grooves 48*a* and a plurality of teeth portions 46*a*. Fitting portion 40*a* is configured to engage the plurality of grooves 44 and the plurality of teeth portions 42 formed within the hole of coupling member 36. Similarly, segment 34*b* comprises fitting portion 40*b* having a plurality of grooves 48*b* and a plurality of teeth portions 46*b*. Fitting portion 40*b* is configured to engage the plurality of grooves 44 and the plurality of teeth portions 42 formed within the hole of coupling member 36.

In some embodiments, coupling member 36 may couple two segments together. In some embodiments, clocking features are provided such that torsion can be transmitted from one segment to another segment. For example, the plurality of grooves 44 and the plurality of teeth portions 42 of coupling member 36 may engage corresponding plurality of grooves and corresponding plurality of teeth portions of segments to transmit torsion from one segment to another segment. Because of the way the plurality of grooves and the plurality of teeth portions are engaged with one another (e.g., being locked in to one another), a torsional force exerted on segment 34*b* may be transmitted to segment 34*a* via coupling member 36.

In some embodiments, coupling member 36 may also be used to couple two structural members together and/or transmit torsion from one structural member to another structural member. In some embodiments, coupling member 36 may be formed on one end of a segment and/or structural member. In some embodiments, coupling member 36 comprises hook 38 for coupling to connecting member 14*b*.

Figure 7A:
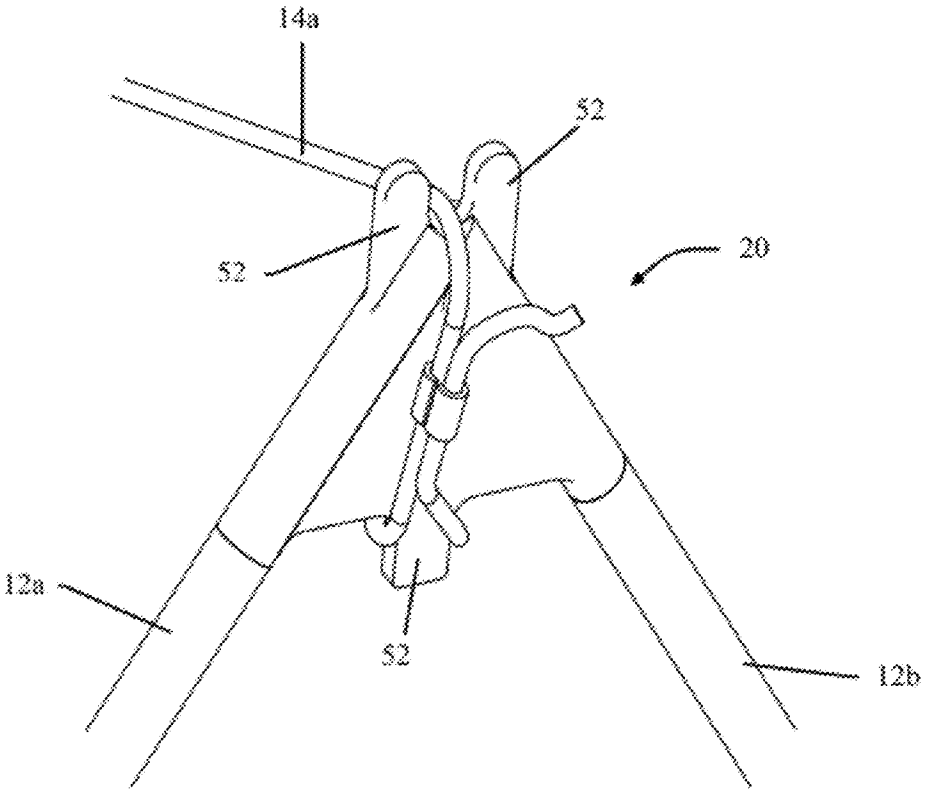
FIGS. 7A and 7B illustrate perspective views of a fastening member, in accordance with various embodiments of the subject technology.
Figure 7B:
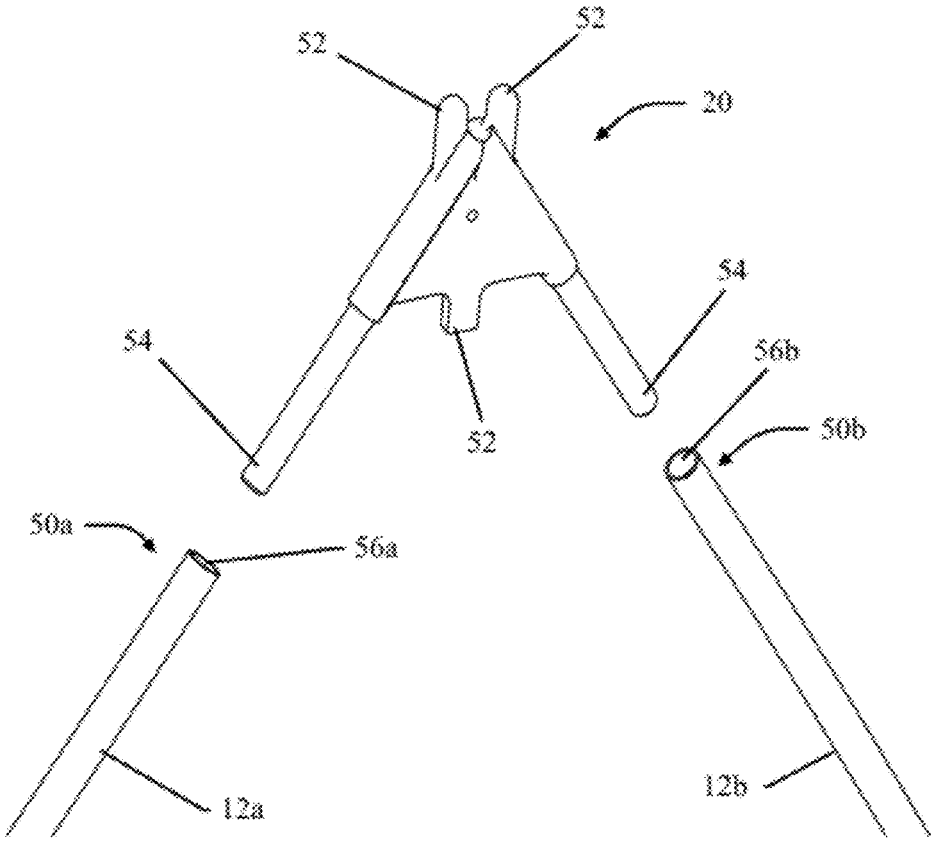

According to various embodiments of the subject technology, a fastening member may be used to couple an end portion of a structural member to at least one of a first part of a connecting member and an end portion of another structural member. FIGS. 7A and 7B illustrate perspective views of fastening member 20, in accordance with various embodiments of the subject technology. In some embodiments, fastening member 20 comprises one or more protrusions 52 configured to engage a connecting member such as connecting member 14*a*. For example, connecting member 14*a* may wrap around protrusions 52 to anchor onto fastening member 20. However, connecting member 14*a* may be coupled to fastening member 20 through other means such as through the use of holes, cleats, notches, bolts, rivets, or other suitable means. In some aspects, fastening member, as used herein, does not necessarily mean that the objects that the fastening member couples to are immovable relative to one another; the fastening member may permit play and or movement of the objects. In some aspects, fastening member, as used herein, is given its ordinary meaning.

As shown in FIG. 7B, fastening member 20 comprises tip portions 54, which may be inserted into holes 56*a* and 56*b* of structural members 12*a* and 12*b* for coupling fastening member 20 to end portions 50*a* and 50*b* of structural members 12*a* and 12*b*. In some embodiments, fastening member 20 may comprise a hole that an end portion of a structural member may be inserted into for coupling fastening member 20 to the end portion.

In the configuration shown in FIGS. 7A and 7B, loads may be transmitted from structural member 12*a* to at least one of structural member 12*b* and connecting member 15*a*. In some embodiments, fastening member 20 may provide a means for resisting movement of structural members 12*a* and 12*b* toward and away from one another.

Figure 8A:
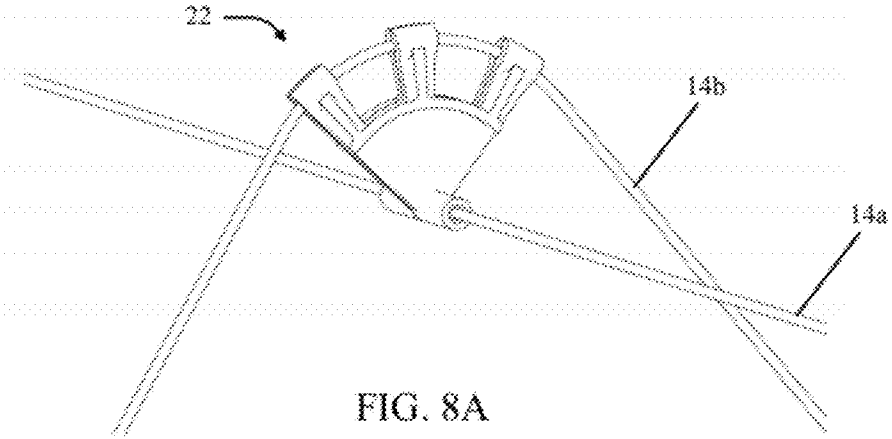
FIGS. 8A, 8B, and 8C illustrate perspective views of a spool, in accordance with various embodiments of the subject technology.
Figure 8B:
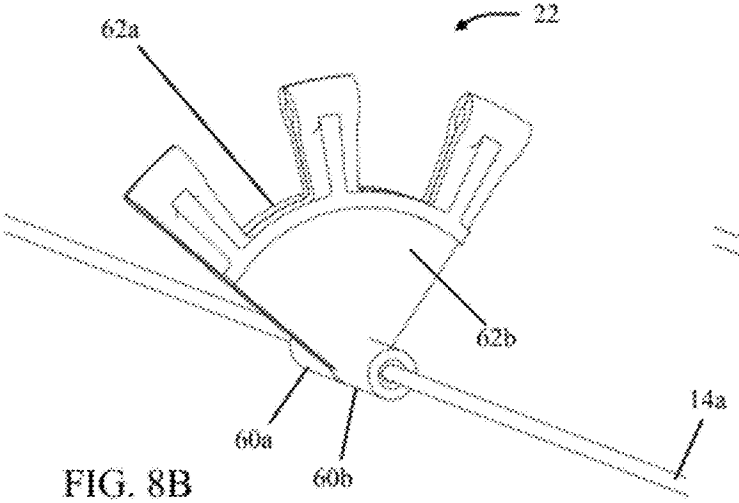
Figure 8C:
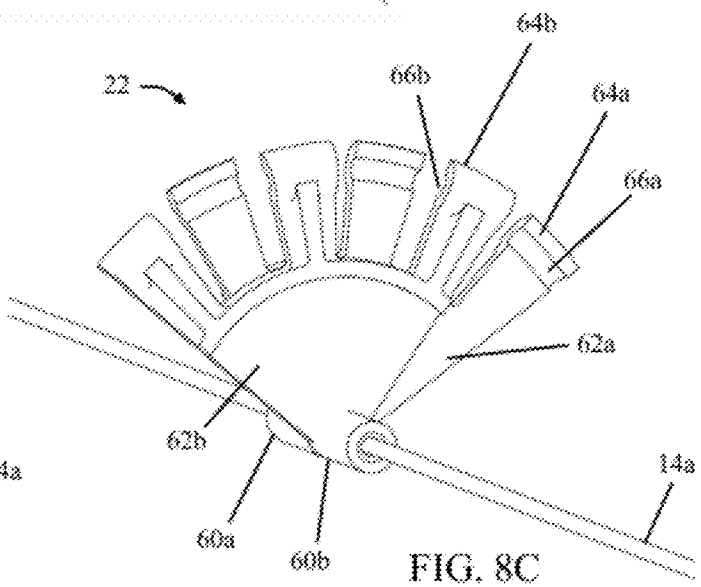

FIGS. 8A, 8B, and 8C illustrate perspective views of spool 22, in accordance with various embodiments of the subject technology. Spool 22 comprises plate 62*a* having node 60*a* defining a first hole through which connecting member 14*a* extends. Plate 62*a* comprises one or more tip portions 64*a* on which one or more grooves 66*a* are defined. The one or more grooves 66*a* are configured to engage connecting member 14*b*. Spool 22 also comprises plate 62*b* having node 60*b* defining a second hole through which connecting member 14*a* extends. Plate 62*b* comprises one or more tip portions 64*b* on which one or more grooves 66*b* are defined. The one or more grooves 66*b* are configured to engage connecting member 14*b*.

In some embodiments, nodes 60*a* and 60*b* couple to one another to form a pivot point such that plate 62*a* and plate 62*b* are rotatable relative to one another about the pivot point. FIGS. 8A and 8B illustrate plates 62*a* and plate 62*b* when they are aligned with one another, while FIG. 8C illustrates plates

62*a* and plate 62*b* when they are not aligned. In some embodiments, when plate 60*a* is aligned with plate 60*b*, the one or more grooves 66*a* and the one or more grooves 66*b* form one or more holes through which connecting member 14*b* extends, as shown in FIG. 8A. In some embodiments, rather than threading connecting member 14*b* through the one or more holes formed by the one or more grooves 66*a* and the one or more grooves 66*b*, connecting member 14*b* may be easily weaved through these grooves when plate 60*a* is not aligned with plate 60*b*, as shown in FIG. 8C.

Figure 9A:
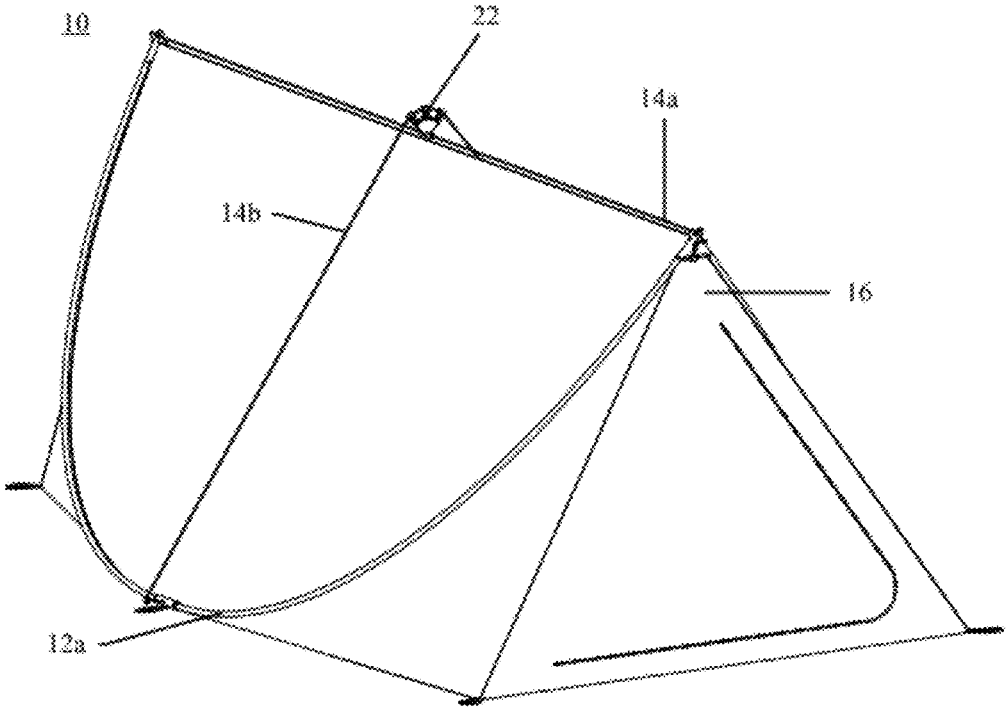
FIGS. 9A, 9B, and 9C illustrate perspective views of a tent, in accordance with various embodiments of the subject technology.
Figure 9B:
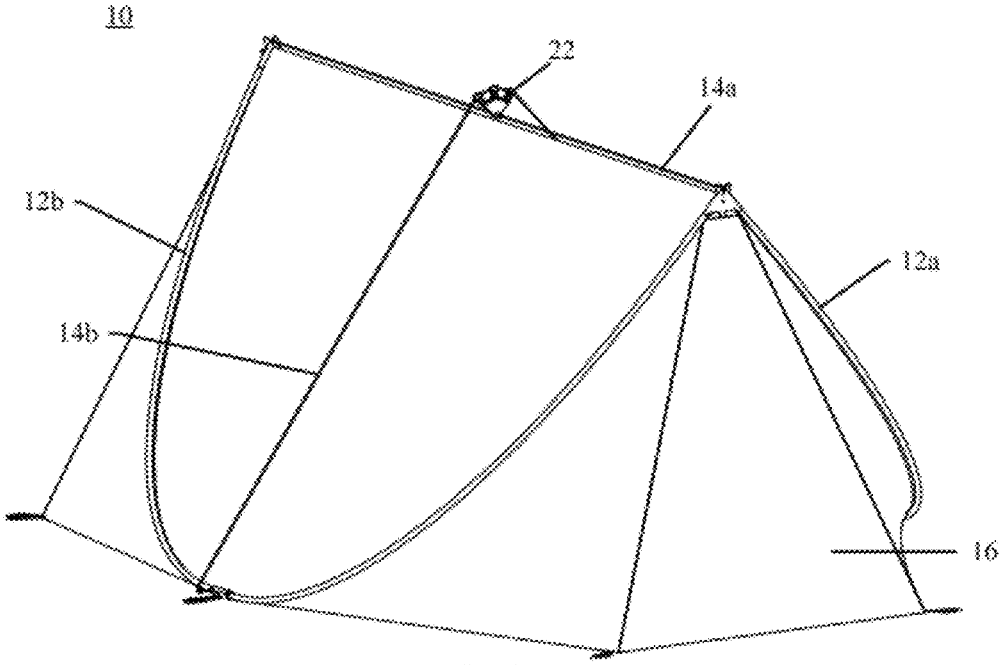
Figure 9C:
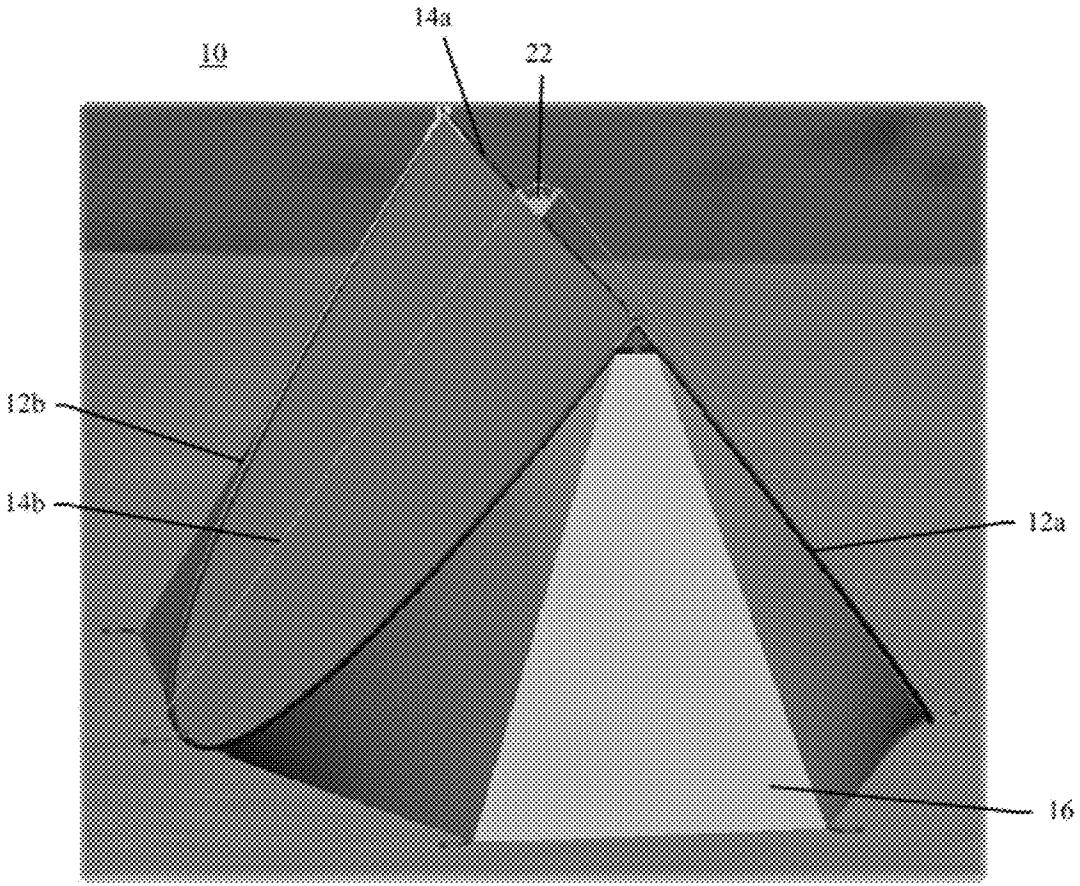

FIGS. 9A, 9B, and 9C illustrate perspective views of tent 10, in accordance with various embodiments of the subject technology. FIG. 9A illustrates one side of tent 10 while FIG. 9B illustrates another side of tent 10. FIG. 9C illustrates a three-dimensional (3D) rendered view of tent 10. Fabric 16 may be coupled to frame 18 in various ways to form tent 10. For example, in some embodiments, fabric 16 may be disposed over frame 18. In some embodiments, fabric 16 may be coupled to frame 18 in an interior of frame 18. In some embodiments, portions of fabric 16 may be coupled to frame 18 in an interior of frame 18 while other portions of fabric 16 may be disposed over frame 18.

Figure 10B:
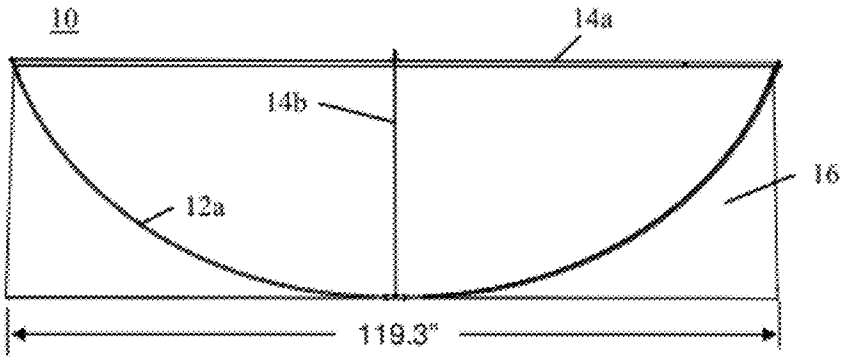
FIGS. 10A, 10B, and 10C illustrate various views of a tent, in accordance with various embodiments of the subject technology.
Figure 10A:
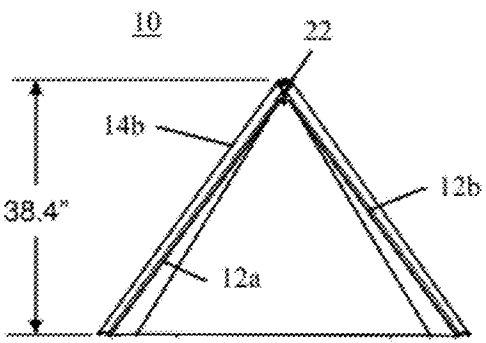
Figure 10C:
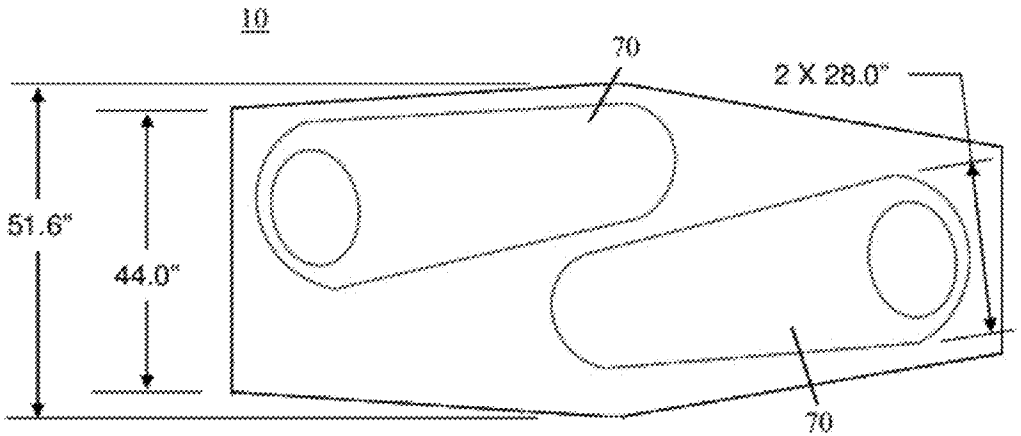

FIGS. 10A, 10B, and 10C illustrate various views of tent 10, in accordance with various embodiments of the subject technology. FIG. 10A illustrates a side view of tent 10, FIG. 10B illustrates a front view of tent 10, and FIG. 10C illustrates a top view of tent 10. Various dimensions of tent 10 are shown in these figures (e.g., in inches). However, the subject technology is not limited to these dimensions. Other suitable dimensions may be utilized for tent 10. Under the dimensions currently shown in FIGS. 10A, 10B, and 10C, tent 10 may comfortably house two people 70 (e.g., as shown in FIG. 10C).

Figure 11B:
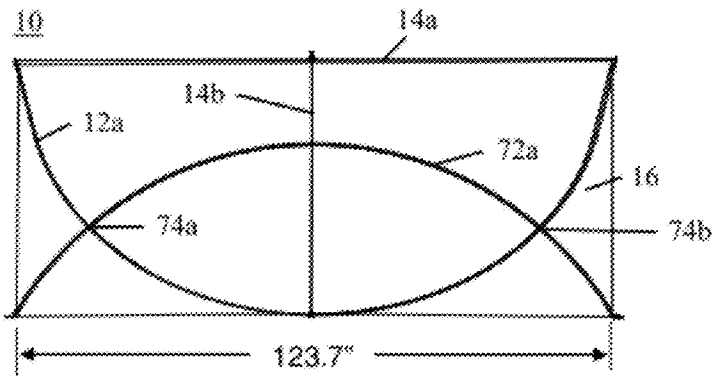
FIGS. 11A, 11B, 11C, and 11D illustrate various views of a tent, in accordance with various embodiments of the subject technology.
Figure 11A:
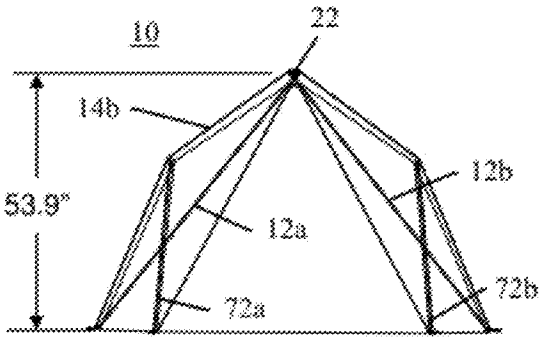
Figure 11C:
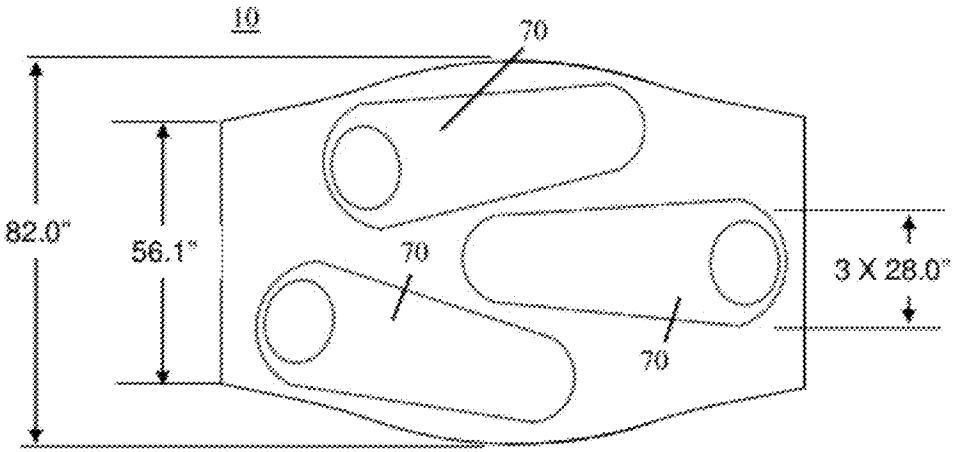
Figure 11D:
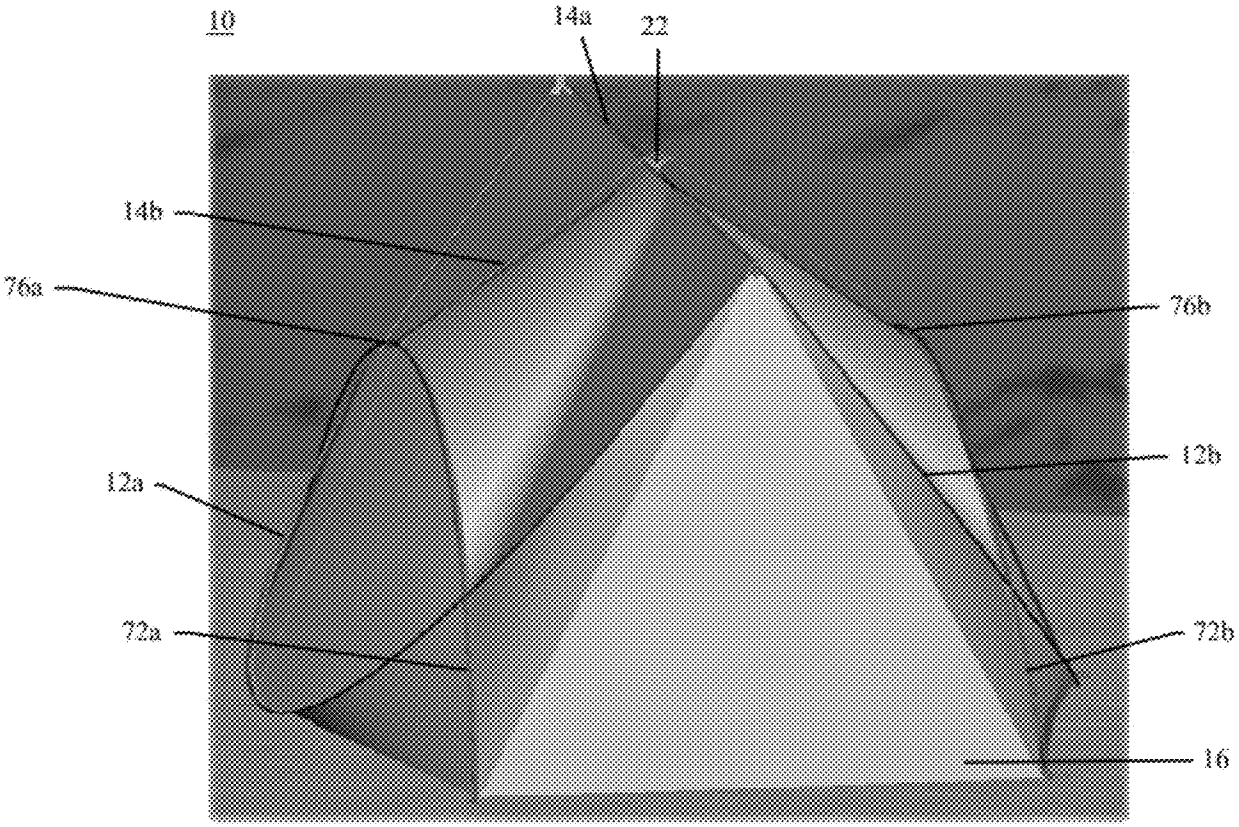

FIGS. 11A, 11B, 11C, and 11D illustrate various views of tent 10, in accordance with various embodiments of the subject technology. FIG. 11A illustrates a side view of tent 10, FIG. 11B illustrates a front view of tent 10, FIG. 11C illustrates a top view of tent 10, and FIG. 11D illustrates a 3D rendered view of tent 10. As discussed above, tent 10 may comprise more than two structural members. For example, in addition to structural members 12*a* and 12*b*, tent 10 may comprise additional structural members that are not necessarily coupled to connecting member 14*a* (e.g., secondary structural members 72*a* and 72*b*).

According to certain embodiments, secondary structural members 72*a* and 72*b* may be used to provide additional support for tent 10 and/or to expand an interior of tent 10. For example, secondary structural members 72*a* and 72*b* may be bent in a concave downward facing direction and extend longitudinally along tent 10. In some embodiments, the end portions of secondary structural members 72*a* and 72*b* may be inserted through grommet holes of fabric 16. Secondary structural member 72*a* may be coupled to structural member 12*a* at two different locations (e.g., locations 74*a* and 74*b*) of secondary structural member 72*a*. For example, clips or other suitable mechanisms may be used to couple secondary structural member 72*a* to structural member 12*a* and/or fabric 16 at locations 74*a* and 74*b*. Secondary structural member 72*b* may be arranged in a similar manner with respect to structural member 12*b*.

According to certain embodiments, connecting member 14*b* engages a mid-region of each of secondary structural members 72*a* and 72*b* (e.g., as shown in points 76*a* and 76*b* in FIG. 11D). The mid-region of each of the secondary structural members 72*a* and 72*b* (e.g., at points 76*a* and 76*b*, respectively) may be at a respective apex. However, connecting member 14*b* may engage secondary structural members 72*a* and 72*b* at other suitable regions. Connecting member 14*b* is configured to restrict movement of secondary structural members 72*a* and 72*b* in at least one of an upward and outward direction relative to tent 10. For example, connecting member 14*b* may push down against secondary structural members 72*a* and 72*b* to restrict secondary structural members 72*a* and 72*b* from traveling upwards in the vertical direction.

Secondary structural members 72*a* and 72*b*, as shown in FIGS. 11A, 11B, 11C, and 11D, may provide additional support for tent 10 as well as expand an interior of tent 10. For example, because secondary structural members 72*a* and 72*b* stand up vertically while structural members 12*a* and 12*b* are slanted with respect to the ground, fabric 16 is stretched wider near the mid-regions of secondary structural member 72*a* and 72*b* than it normally would be without secondary structural members 72*a* and 72*b*. Thus, the interior of tent 10 is expanded with additional space. Various dimensions of tent 10 are shown in FIGS. 11A, 11B, and 11C (e.g., in inches). The subject technology is not limited to these dimensions, but may include other suitable dimensions. Under the dimensions currently shown in FIGS. 11A, 11B, and 11C, tent 10 may comfortably house three people 70 (e.g., as shown in FIG. 11C).

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A tent frame comprising:

a plurality of structural members, each having a first end portion and a second end portion; and a first connecting member having a first part and a second part, a spool that couples to the first connecting member; and a second connecting member that couples to the spool and having a first part and a second part, wherein the first end portion of each of the plurality of structural members couples to the first part of the first connecting member, and the second end portion of each of the plurality of structural members couples to the second part of the first connecting member, such that at least one of a tensional force, a bending force, a compressive force, and a torsional force is exerted on each of the plurality of structural members, wherein at least a first one of the plurality of structural members and the first connecting member form a first side of a tent frame, wherein at least a second one of the plurality of structural members and the first connecting member form a second side of the tent frame, and wherein, when the at least one of the tensional force, the bending force, the compressive force, and the torsional force is decreased, the tent frame expands longitudinally;

wherein the first part of the second connecting member couples to the first one of the plurality of structural members;

wherein the second part of the second connecting member couples to the second one of the plurality of structural members.

2. The tent frame of claim 1, wherein each of the plurality of structural members comprises at least one of a pole, a rod, a pipe, a lug, a clip, and a cam.

3. The tent frame of claim 1, wherein the first connecting member comprises at least one of a cord, a string, a rope, a cable, and a guy line.

4. The tent frame of claim 1, wherein, when the tent is in an upright position, the first connecting member extends longitudinally along a top portion of the tent and the plurality of structural members are bent in a concave upward facing direction, and wherein the longitudinal direction extends from the first ends to the second ends of the plurality of structural members.

5. The tent frame of claim 1, further comprising a fastening member configured to couple the first end portion of the first one of the plurality of structural members to at least one of the first part and the first end portion of the second one of the plurality of structural members.

6. The tent frame of claim 5, wherein the fastening member comprises one or more protrusions configured to engage the first connecting member.

7. The tent frame of claim 5, wherein the fastening member comprises one of a hole and a tip portion, wherein the first end portion of the first one of the plurality of structural members comprises the other of the hole and the tip portion, wherein the tip portion is configured to insert into the hole for coupling the fastening member to the first end portion of the first one of the plurality of structural members.

8. The tent frame of claim 1, wherein at least one of the plurality of structural members comprises a plurality of segments that couple to one another to form the at least one of the plurality of structural members.

9. The tent frame of claim 8, further comprising a coupling member having a plurality of grooves and a plurality of teeth portions formed within a hole defined through the coupling member, wherein each of the plurality of segments comprises at least one fitting portion having a plurality of grooves and a plurality of teeth portions, the at least one fitting portion being configured to engage the plurality of grooves and the plurality of teeth portions formed within the hole of the coupling member.

10. The tent frame of claim 1, wherein the first part of the second connecting member couples to a mid-region of the one of the two structural members, and wherein the second part of the second connecting member couples to a mid-region of the another of the two structural members.

11. The tent frame of claim 1, the spool comprises:

a first plate having a first node defining a first hole through which the first connecting member extends, the first plate having a first tip portion on which a first groove is defined, the first groove configured to engage the second connecting member; and a second plate having a second node defining a second hole through which the first connecting member extends, the second plate having a second tip portion on which a second groove is defined, the second groove configured to engage the second connecting member, wherein the first node and the second node couple to one another to form a pivot point such that the first plate and the second plate are rotatable relative to one another about the pivot point, wherein, when the first plate is aligned with the second plate, the first groove and the second groove form a third hole through which the second connecting member extends.

12. A tent frame comprising:

a plurality of structural members, each having a first end portion and a second end portion; and a first connecting member having a first part and a second part, a spool that couples to the first connecting member; and a second connecting member that couples to the spool and having a first part and a second part, wherein the first end portion of each of the plurality of structural members couples to the first part of the first connecting member, and the second end portion of each of the plurality of structural members couples to the second part of the first connecting member, such that at least one of a tensional force, a bending force, a compressive force, and a torsional force is exerted on each of the plurality of structural members, wherein one of the plurality of structural members and the first connecting member form a first side of a tent frame, wherein another of the plurality of structural members and the first connecting member form a second side of the tent frame, and wherein, when the at least one of the tensional force, the bending force, the compressive force, and the torsional force is decreased, the tent frame expands longitudinally;

wherein, when the tent is in an upright position, the first connecting member extends longitudinally along a top portion of the tent and the plurality of structural members are bent in a concave upward facing direction;

wherein the plurality of structural members comprises two structural members;

wherein the first part of the second connecting member couples to one of the two structural members, wherein the second part of the second connecting member couples to another of the two structural members.

13. The tent frame of claim 12, wherein the first part of the second connecting member couples to a mid-region of the one of the two structural members, and wherein the second part of the second connecting member couples to a mid-region of the another of the two structural members.

14. The tent frame of claim 12, wherein, when a transverse force is exerted on at least one of the two structural members urging the two structural members toward one another, the second connecting member exerts a counter-transverse force on at least one of the two structural members to resist the transverse force.

15. The tent frame of claim 12, further comprising at least one secondary structural member, wherein the at least one secondary structural member is bent in a concave downward facing direction and extends longitudinally along the tent frame, and wherein the second connecting member is configured to engage a mid-region of the at least one secondary structural member.

16. The tent frame of claim 15, wherein the second connecting member is configured to restrict movement of the at least one secondary structural member in at least one of an upward and outward direction relative to the tent frame.

17. The tent frame of claim 15, wherein the at least one secondary structural member is coupled to one of the two structural members at two different locations of the at least one secondary structural member.

18. The tent frame of claim 12, the spool comprises:

a first plate having a first node defining a first hole through which the first connecting member extends, the first plate having a first tip portion on which a first groove is defined, the first groove configured to engage the second connecting member; and a second plate having a second node defining a second hole through which the first connecting member extends, the second plate having a second tip portion on which a second groove is defined, the second groove configured to engage the second connecting member, wherein the first node and the second node couple to one another to form a pivot point such that the first plate and the second plate are rotatable relative to one another about the pivot point, wherein, when the first plate is aligned with the second plate, the first groove and the second groove form a third hole through which the second connecting member extends.

19. A tent comprising a tent frame, the tent frame comprising:

a plurality of elongate structural members each having a first end portion, a second end portion, and a middle portion between the first end portion and the second end portion, each of the plurality of elongate structural members defining an axis extending along the elongate structural members, the axis of the elongate structural members being substantially straight when the structural members are in a collapsed configuration and being substantially arcuate when the structural members are in a deployed configuration; and a connecting member that extends between the first end portion and the second end portion of the plurality of elongate structural members, the connecting member drawing the first end portion and the second end portion together, thereby changing the plurality of structural members from the collapsed configuration to the deployed configuration and reducing a length of the connecting member between the first end portion and the second end portion;

wherein the middle portions of first and second elongate structural members, of the plurality of structural members, are separated by a distance greater than a distance separating the first end portions of the first and second elongate structural members;

wherein, when the tent frame is in an upright position, the connecting member extends near a top of the tent and the plurality of structural members are bent such that the first end portion and the second end portion of each structural member of the plurality of structural members is above the middle portion of the respective structural member; and wherein the first and second elongate structural members each comprise a pole.

20. The tent of claim 19, further comprising at least one secondary structural member, wherein the at least one secondary structural member is bent in a concave downward facing direction and extends longitudinally along the tent frame.

21. The tent of claim 19, wherein at least one of the first and second structural members comprises a plurality of segments that couple to one another to form the at least one of the first and second structural members.

* * * * *